United States Patent [19]

Garofalo

[11] Patent Number: 4,887,985

[45] Date of Patent: Dec. 19, 1989

[54] SWIM FIN PROVIDED WITH A SELF-SHAPING, FLUID FLOW CONVEYING AND CONTROLLING CANAL-LIKE MEMBER

[75] Inventor: Giovanni Garofalo, Rapallo, Italy

[73] Assignee: AMF Incorporated, N.J.

[21] Appl. No.: 151,941

[22] Filed: Feb. 3, 1988

Related U.S. Application Data

[63] Continuation of Ser. No. 870,383, Jun. 4, 1986, Pat. No. 4,738,645.

[30] Foreign Application Priority Data

May 3, 1984 [IT] Italy ..... 12507 A/84

[51] Int. Cl.[4] ..... A63B 31/08

[52] U.S. Cl. ..... 441/64; 264/273

[58] Field of Search ..... 441/64, 55, 56, 57, 441/61; D21/239; 264/273, 274, 261

[56] References Cited

U.S. PATENT DOCUMENTS

| | | | |
|---|---|---|---|
| 3,411,165 | 11/1968 | Murdoch | 441/64 |
| 3,649,979 | 3/1972 | MacNeil | 441/64 |
| 3,810,269 | 5/1974 | Tabata et al. | 441/64 |
| 3,913,158 | 10/1975 | Vilarrubis | 441/64 |
| 3,922,741 | 12/1975 | Semeia | 441/64 |
| 3,978,537 | 9/1976 | Shamlian | 441/64 |
| 4,083,071 | 4/1978 | Forjot | 441/64 |
| 4,300,255 | 11/1981 | Beuchat | 441/64 |

FOREIGN PATENT DOCUMENTS

| | | | |
|---|---|---|---|
| 7619820 | 1/1978 | France | 441/64 |
| 7711787 | 11/1978 | France | 441/64 |
| 8008356 | 10/1981 | France | 441/64 |
| 2506619 | 12/1982 | France | 441/64 |
| 2524377 | 10/1983 | France | 264/273 |
| 1066618 | 10/1984 | U.S.S.R. | 441/64 |

*Primary Examiner*—Joseph F. Peters, Jr.
*Assistant Examiner*—Paul E. Salmon
*Attorney, Agent, or Firm*—Finnegan, Henderson, Farabow, Garrett & Dunner

[57] ABSTRACT

A swim fin provided with a canal-like member for conveying and controlling the fluid flow produced during each swimming stroke. The fin comprises at least at the central portion of its blade a section which, by dynamical deformation, gives rise to a canal-like fluid flow conveying member on that side of the fin opposed to the side under active stroke. The canal-like member is inverted as soon as the swimming stroke is reversed, so as to perform its fluid flow conveying action during both swimming strokes.

25 Claims, 6 Drawing Sheets

101
601
301
107
IX
7
701
201
401
402
403
202
X
402'
501
2

SWIM FIN PROVIDED WITH A SELF-SHAPING, FLUID FLOW CONVEYING AND CONTROLLING CANAL-LIKE MEMBER

This is a continuation of Application Ser. No. 06/870,383 filed June 4, 1986, which issued as U.S. Pat. No. 4,738,645 on Apr. 19, 1988, which application was a continuation-in-part of Application Serial No. 06/726/534 filed Apr. 24, 1985, now abandoned.

FIELD OF THE INVENTION

This invention relates to swim fins, and more particularly to the swim fins of the kind in which the fluid jet or fluid flow produced during the propulsive swimming stroke is directed and conveyed in the active propulsive direction.

BACKGROUND OF THE INVENTION

It is known, for instance from U.S. Pat. No. 3,649,979 to MacNiel; U.S. Pat. No. 3,913,158 to Vilarrubis; U.S. Pat. No. 4,083,071 to Forjot and French Patent Application No. 2,355,529 to Beuchat to provide swim fins with a passage extending longitudinally through the fin from an inlet remote from the free end of the fin to a discharge at the free end of the fin, so that in the ordinary use of the fin water will be drawn into the inlet and discharged from the free end to impart additional thrust to the swimmer.

The said prior art known fins are effective in their intended action only during one stroke of the fin. Moreover, due to their construction, they are unduly rigid and heavy and therefore overstraining.

It is further known from U.S. Pat. No. 3,411,165 to Murdoch a swim fin comprising: a semirigid shoe-like member from which inflexible ribs are extending forwardly at each side thereof; and a thin web-like membrane wider than the space between said ribs, secured to the sides of said ribs and to the front of the shoe-like member so that said web-like membrane may belly oppositely between said ribs during swimming.

The said prior art fin to Murdoch has many disadvantages. First of all, it may be said that it is very difficult to make the ribs of such a fin substantially inflexible in vertical planes without providing them with an internal metallic stiffening member. This implies that the shoe-like member supporting the said stiffening members of the ribs be made form a semirigid material in order to resist to the forces tending to flex said ribs in vertical planes. This is a remarkable disadvantage for a fin, since it is known that the overall tendency is to make the shoe-like member of a fin with a material as supple as possible, in order to afford greater comfort to the user's feet, thus avoiding injuries to the feet. Moreover, the said ribs are subjected to forces tending to flex them in horizontal planes, thus reducing the projection of the active surface of the web-like membrane during each swimming stroke, which reduces the propulsive efficiency of the fin at each swimming stroke.

From French Patent Application No. 2,506,619 to Beuchat et al., a swim fin is known comprising a shoe portion connected to a first rigid portion of the fin blade, from which two lateral reinforcing ribs extend forward in a diverging manner. Between the said ribs a supple flexible middle portion is disposed, connected to the reinforcing ribs by two sections in the shape of half truncated cones, which forms the blade of the fin. The said known fin presents the same disadvantages mentioned with respect to the Murdoch fin (U.S. Pat. No. 3,411,165) in respect of the reduction of its active surface during each swimming stroke. Moreover, it is known that, the more the fin blade is supple, the more it is subject to elastic deformation, with the result that the thrust on the swimmer is partially lost. This is particularly true at the points of inversion of the stroke of the fin, at which same is caused to flex from one position to the new one, with consequent additional loss of propulsive power. This is the main reason because there is the tendency to make the blades of the fins as rigid as possible in order to achieve the best results.

In the fin according to the above discussed French Patent Application No. 2,506,619 the above mentioned advantages are not achieved, or are achieved only partially, due to the fact that the main portion of the fin blade is made of supple material.

SUMMARY OF THE INVENTION

It is therefore the main object of the present invention to provide a swim fin comprising a shoe portion made of relatively supple material and a blade portion made of a comparatively stiff material confined between two lateral stiffening ribs, in which the said blade portion of the fin is provided sidewise, at positions close to, but spaced from the said ribs with two narrow openings or slits extending from the fore edge of the said stiff blade portion in a longitudinal direction substantially parallel to the said ribs up to in proximity of the root portion of the blade of the fin, and in which two bulged membrane-like elements of a material which is more supple and flexible than the material forming the fin blade are connected and formed integral with the edges of said slits.

Thanks to the above features, a swim fin is obtained provided with a deformable canal-like member formed by the substantially stiff middle portion of the blade and by the adjoining supple bulged membrane-like elements which may change their direction of flexion at each inversion of the swimming stroke, so that the fluid flow is always conveyed in substantial amounts in a propulsive direction.

Thanks to fact that the said slits are formed at positions close, but still spaced from the lateral stiffening ribs of the fin, the lateral ribs are not subjected to forces in a horizontal plane tending to reduce the active surface area of the blade.

Thanks to the presence of the lateral ribs and of the canal-like structure, also the longitudinal rigidity of the fin is increased, without unduly increasing its thickness, or the thickness of the stiffening ribs of the fin.

Thanks to the fact that the fin blade is mainly made from a comparatively stiff material, the fin quickly reassumes its propulsive attitude at the inversion points of the swimming stroke.

According to a further characteristics feature of the invention, the said supple membrane-like elements are made integral with the stiff fin blade by molding the said membrane like elements on the fin blade.

In order to obtain a firm and reliable bond between the said blade and the molded membrane-like elements, the edges of the slits of the blade element to which the said membrane-like elements are secured, are preferably tenon-like shaped and the said tenon-like extensions of the slit edges, or the slit edges themselves, may be provided with recessed apertures, in the form of slots, or in the form of through bores, which are filled by the material of the said membrane-like elements during the molding operation of the said membrane-like elements.

It is known from U.S. Pat. No. 3,922,741 to Semeia that a swim fin comprising a blade member can be made from a relatively stiff plastic material molded to a shoe member made from a relatively soft synthetic elastomer, said blade member having two side ribs laterally surrounding at least the fore end of the shoe member, said blade member and said lateral ribs being provided with openings through which the molded shoe material may penetrate, in order to provide a firm mechanical bond between blade and shoe members.

It is however pointed out that the problem which the above Semeia patent aims to resolve is that of providing, in a fin of the kind disclosed, a reliable bond between blade and shoe members of the fin, and not that of providing a bond between different portions of the blade of a fin. The said problems are quite different. In fact, whilst for providing a bond between shoe and blade members of a fin a great mechanical resistance is requested in order to withstand stresses directed mainly in vertical planes, in making a fin blade according to the invention in which different portions of the fin blade having different elasticity features must be connected together, the stresses to which said blade is subjected are mainly directed in horizontal planes.

Advantageously, the flow-conveying effect of the fin according to the invention may be increased by decreasing the intersection angle between the inwardly facing flanks of the stiffening ribs of the fin and the surface of the fin blade, and by increasing the height of the said ribs.

According to a further characteristic feature of the invention, it has been noted that in manufacturing a fin blade formed by different sections made from different materials having, besides different characteristics of elasticity and softness, also different shrinkage coefficients, there may be the need to provide across the said blade sections a supplementary bond which may withstand the stresses to which the fin blade is subjected during use.

The above object is attained in the fin according to the invention by molding along the fore edge of the fin blade a continuous front strip of elastic supple material.

Whenever the said membrane like elements of the fin are formed by molding an elastic moldable material into the preformed slits of the fin blade, the said continuous front strip of elastic supple material is preferably formed by the same material of the membrane-like elements, and is molded concurrently with the molding step of the said membrane-like elements.

BRIEF DESCRIPTION OF THE DRAWINGS

Further objects, features and advantages of the fin according to the invention will be evident from the following description of some preferred embodiments of the invention, made with reference to the annexed drawings, in which.

DESCRIPTION OF SOME EMBODIMENTS OF THE INVENTION.

Figure 1:
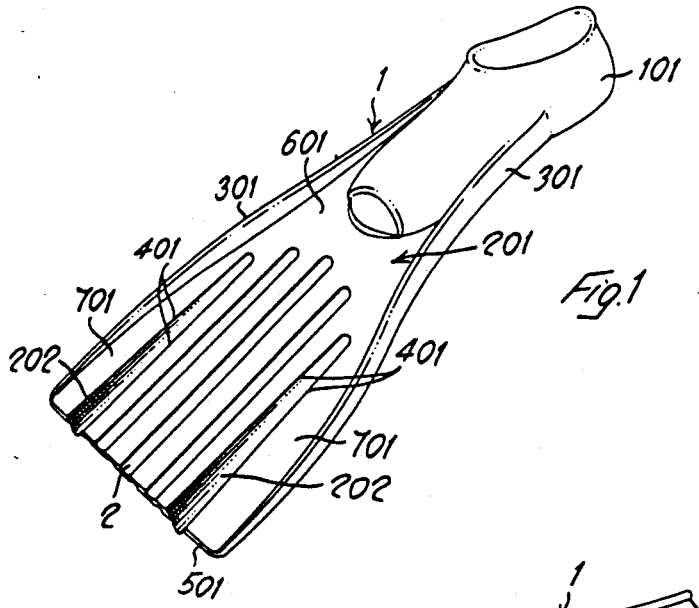
FIG. 1 is a perspective view of a fin according to a first embodiment of the invention.
Figure 2:
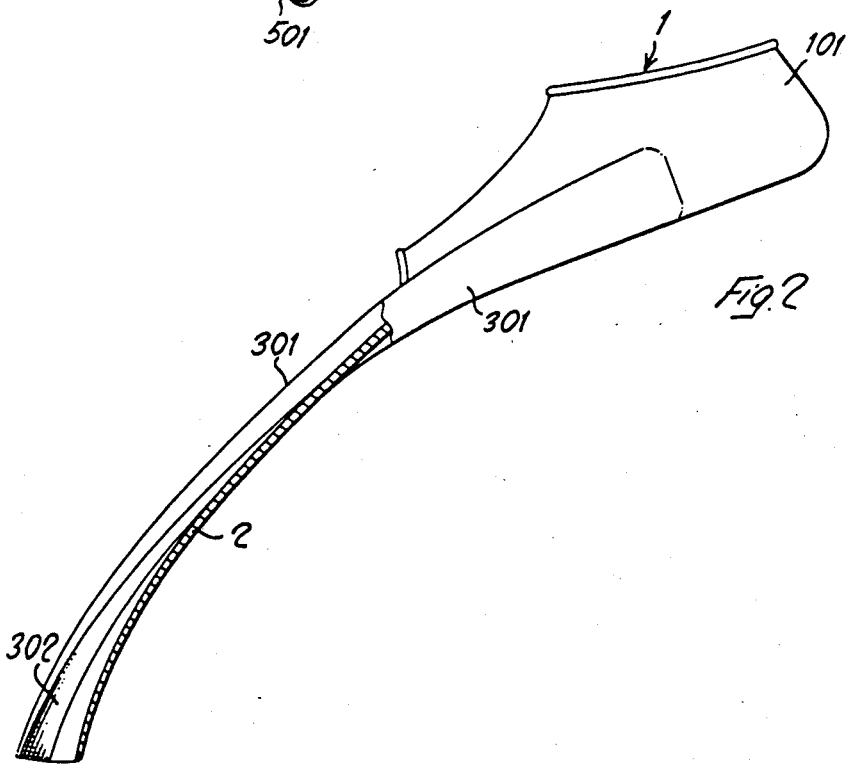
FIG. 2 is a partially sectioned side view of the fin of FIG. 1.
Figure 3:
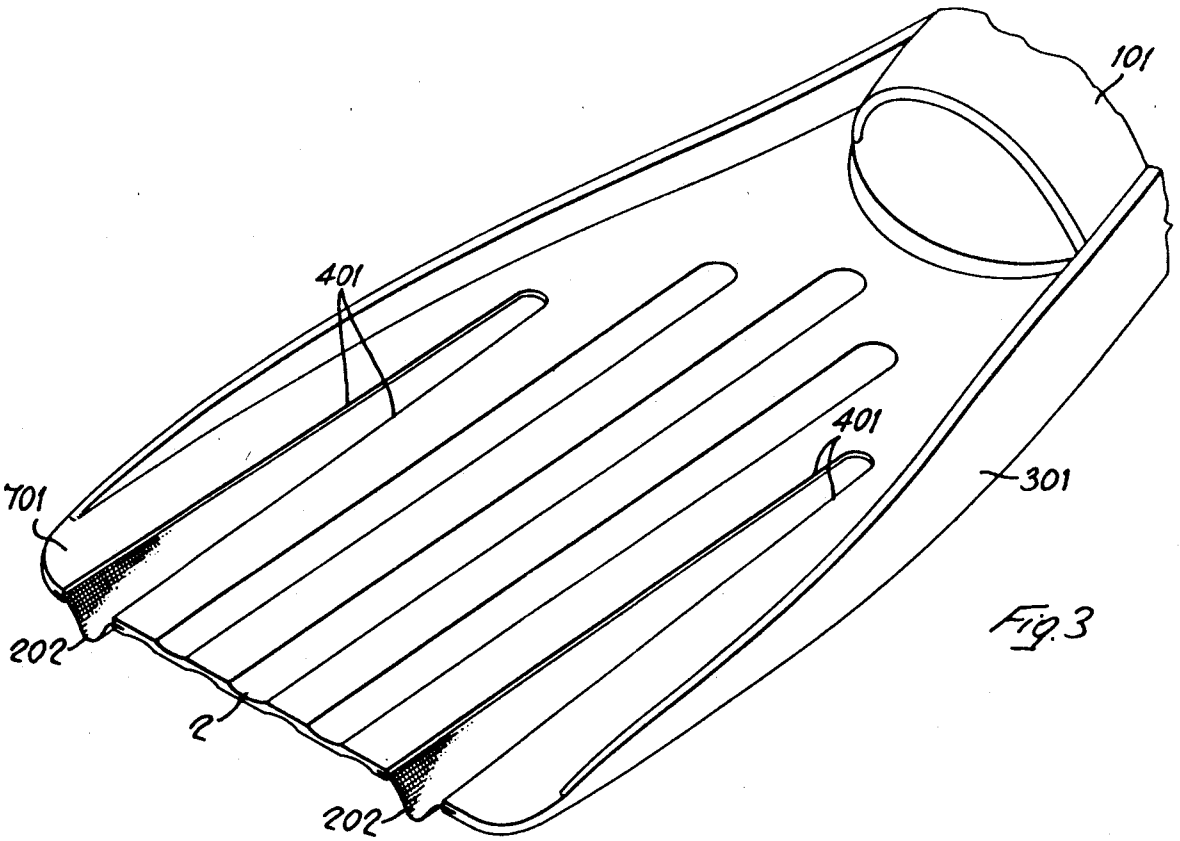
FIG. 3 is a perspective enlarged view of the blade of the fin according to FIG. 1.

With reference to the drawings, and with particular reference to FIGS. 1 to 3, numeral 1 generally denotes the fin according to the invention.

The said fin 1 comprises, in a manner per se known, a shoe portion 101, a blade portion shown generally by reference numeral 201, and two side ribs 301 for stiffening the blade 201. According to the invention, the blade 201 is sidewise provided with two longitudinal narrow openings of slits 401 formed at positions close to the ribs 301, yet spaced from the said ribs by the side portions 701 of the blade 201. The slits 401 extend in a direction substantially parallel to the side ribs 301, from the free edge 501 of the blade 201 up to in proximity of the root portion 601 of the blade, so as to define a central wing-like member 2, integral with the root portion 601 of the blade of the fin. The said central wing like member 2 is connected to the two side portions 701 of the blade 201 through two bulged flexible membranes 202, allowing the wing 2 to yieldably flex by a small angle with respect to the plane of the blade 201, around its root portion.

The above described feature according to which two side portions 701 of the blade are left adjacent to the ribs 3401 is very important, since thanks to the said feature a "T" or "L" shaped structure is formed at the sides of the fin blade by the cooperation of the ribs 301 with the side portions 701, which structure may withstand in an efficient manner forces tending to reduce the effective surface area of the fin blade during swimming.

Figure 4:
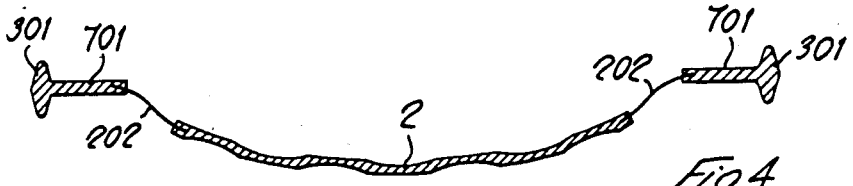
FIGS. 4 and 5 are two diagrammatical views, in cross section, of the blade of the fin according to FIGS. 1 to 3, in two positions respectively corresponding to the two main swimming strokes.
Figure 5:
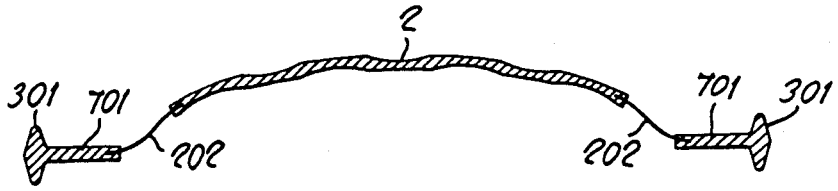

In FIGS. 4 and 5 are diagrammatically shown the two positions of flexion which are assumed by the central portion 2 of the blade during the two swimming strokes, with formation of the corresponding canals for conveying the fluid flow produced during the swimming stroke.

Figure 6:
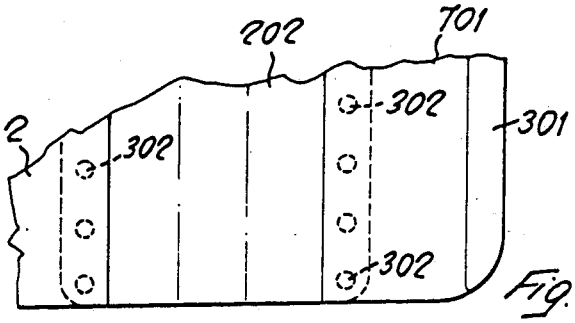
FIG. 6 is an enlarged plan view of a particular of the mode of connecting the flexible membranes to the side and central portions of the fin blade of the fin according to FIGS. 1 to 5.

The flexible membranes 202 may be made and connected to the fin in different manners. According to the embodiment shown in FIG. 6 and 7, the said membranes, which may be made of rubber-coated fabric, thermoplastic material, rubber or the like, are connected to the blade 201 by incorporating their side edges into the edges of the slits 401 of the fin.

Advantageously, the edges of the membranes 202 are formed with spaced holes 302, in order to provide a more reliable bond with the fin blade during the molding of the said blade.

Of course the said membranes may be made and secured to the fin in other manners, and may be also made integral with the fin itself during molding, as it will be better explained later.

Figure 7:
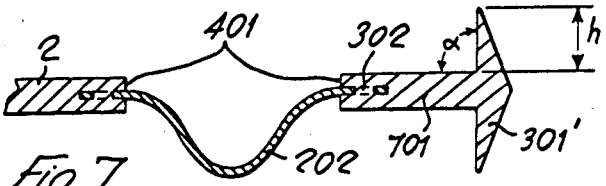
FIG. 7 is a cross sectional view of a particular of a fin according to another embodiment of the invention.

As best shown in FIG. 7, the angle alpha between the inwardly facing flanks of the ribs 301' and the surface of the the side portions 701 of fin blade may be decreased up to a value of about 90°, and moreover the height h of the said ribs may be increased, in order to further enhance the conveying action of the fluid flow longitudinally with respect to the fin, thus eliminating or reducing as much as possible propulsion losses due to side leakages.

DESCRIPTION OF ANOTHER PREFERRED EMBODIMENT OF THE INVENTION

Figures 8, 9, 10:
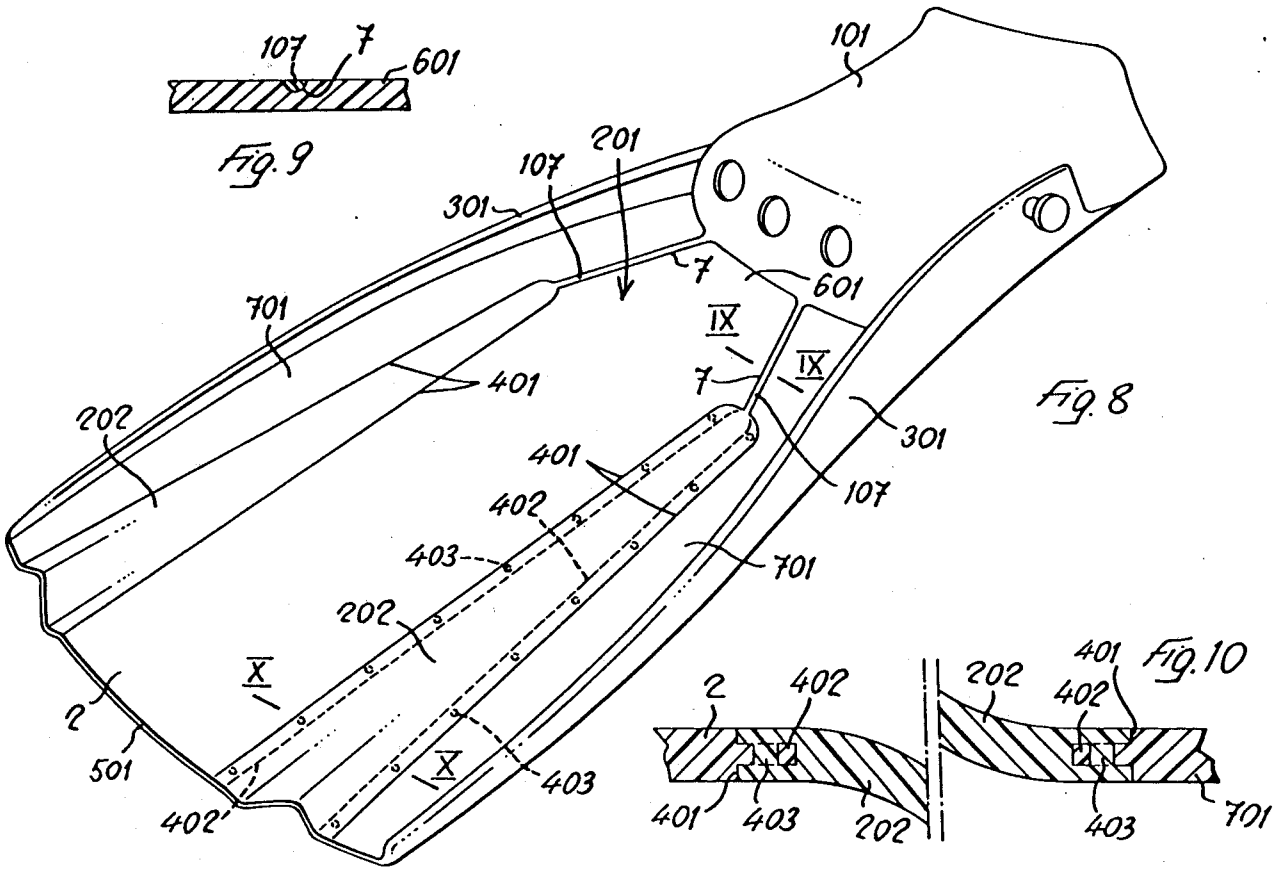
FIG. 8 is a perspective view of still another embodiment of a fin according to the invention, in which the bulged flexible membrane elements made from a material different from the material of the fin blade, are molded on, and made integral with the fin blade.
FIG. 9 is a particular in enlarged scale in cross section along line IX—IX, of the fin shown in FIG. 8.
FIG. 10 is a particular in enlarged scale in cross section along line X—X, of the fin shown in FIG. 8.

In FIGS. 8 to 10 a further embodiment of the invention is shown, which is particularly advantageous.

According to the embodiment shown in FIGS. 8 to 10 the apexes of the slits 401 formed in the blade 201, made of a comparatively stiff material, are connected to the outermost end of the root portion 601 of the blade by means of grooves 7 formed in the said root portion 601 of the blade.

During the following molding step of the shoe portion of the fin, which is made of a material more supple and flexible than the material of the blade 201, and for instance from thermoplastic rubber, the thermoplastic rubber is allowed to flow through said groove 7, in form of a fluid ribbon 107, up to the interior of the slits 401, filling completely said slits and thus forming the bulging membrane-like portions 202, which are in this manner perfectly welded to the remaining portions of the fin blade (see FIG. 9).

Of course the groove 7 may be formed on the surfaces of the portion of the mold associated with the fin blade, instead of on the fin blade, or on both said elements. Moreover, although the membrane-like portions 202 have been shown as having a thickness which is substantially equal to the thickness of the blade portion of the fin, they may be made obviously less thick than the blade portion of the fin.

In order to further improve the bond between the membrane 202 and the blade sections 2 and 701, the edges of the slits 401 may be provided, as shown in FIG. 10, with a tenon-like ridge 402, provided with a number of through holes 403, which are filled, during the molding operation, by the membrane-forming material, thus assuring a secure bond between said membranes 202 and the blade elements 2, 701.

In alternative, the edges of the slits 401 may be provided with recesses in the form of slots or the like, for the same purposes as explained above.

It will be evident that the above embodiment of the invention greatly simplifies the manufacture of the fin.

DESCRIPTION OF SOME FURTHER EMBODIMENTS OF THE INVENTION

Figure 11:
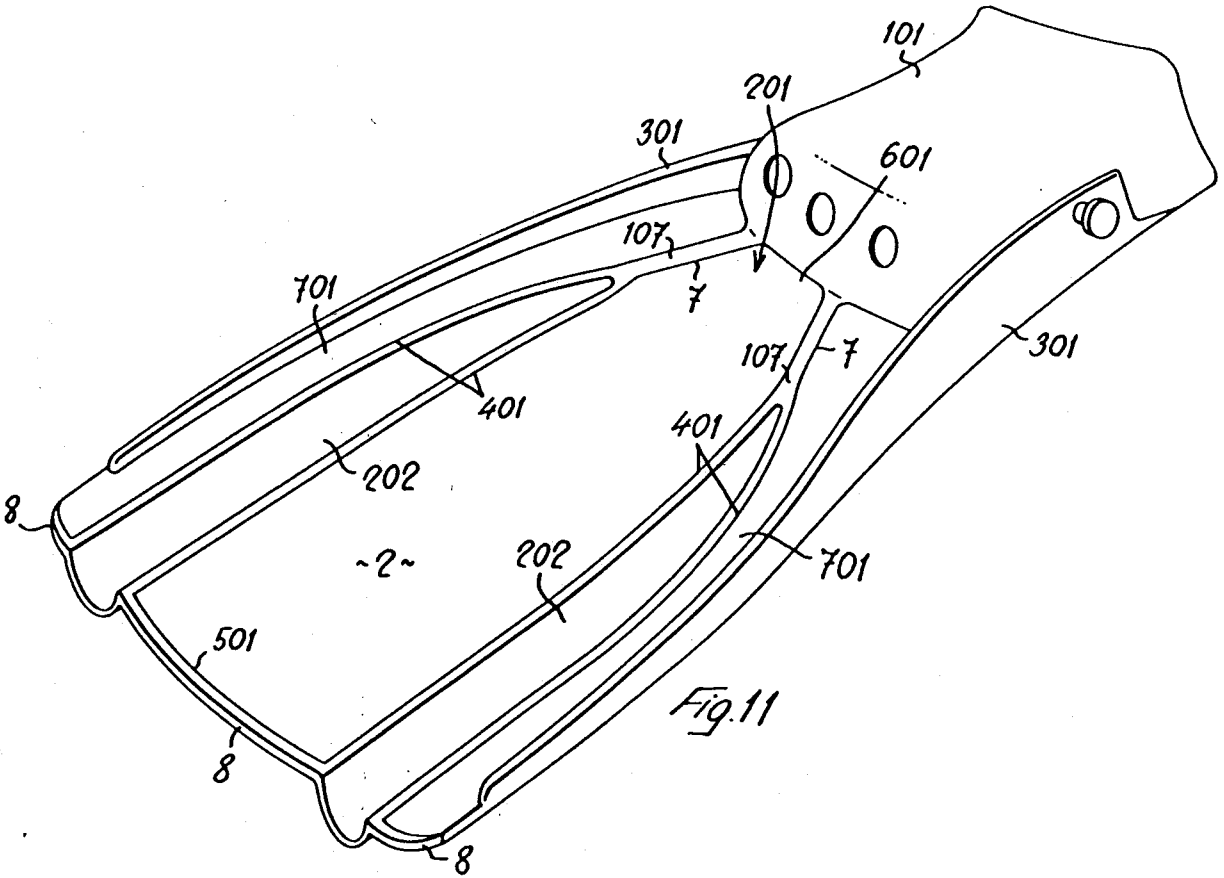
FIG. 11 shows still another embodiment of a fin according to the invention, provided at its fore edge with a molded continuous strip of elastic supple material.

In FIG. 11 an embodiment of the invention is shown which basically corresponds to the embodiment of the fin shown in FIG. 8, and the same reference numerals are used to indicate the same or corresponding parts.

According to this embodiment, during the molding operation of the membranes 202, the material of the said membranes is allowed to further flow along the fore edge of the fin blade 2, by providing a suitable flow-space at the fore end of the mold, so as to form a continuous border or strip 8 of the same material as the membranes 202, extending along, and welded to the whole fore edge of the fin blade.

Figures 12, 13:
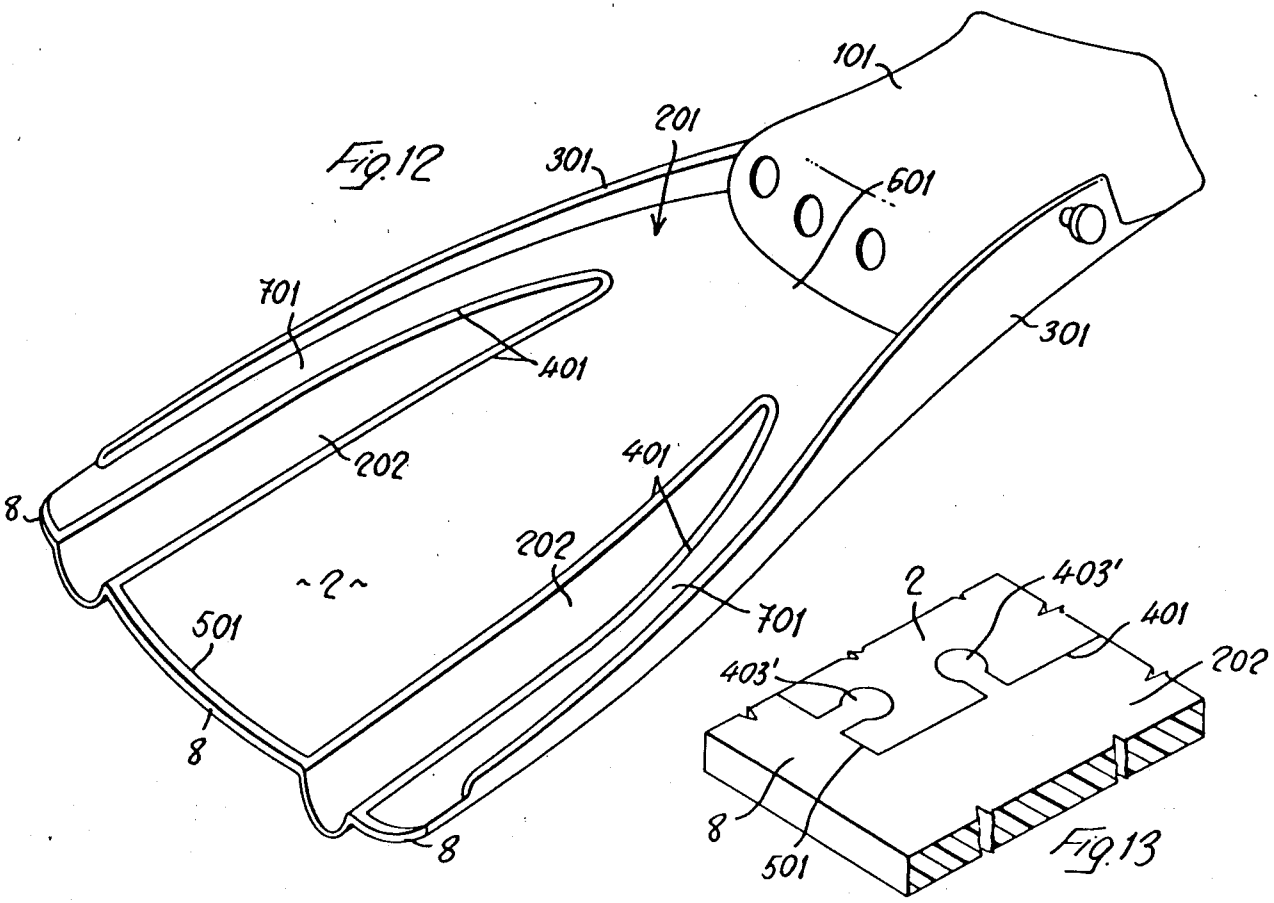
FIG. 12 is a modified embodiment of a fin according to the invention, provided with the continuous front strip shown in FIG. 11.
FIG. 13 is a particular, in enlarged scale, of the fin of FIG. 12.

In FIG. 12 another embodiment of the invention is shown, according to which the membranes 202 as well as the continuous fore strip 8 are molded by injecting the supple material from the side of the mold (not shown) facing the fore end of the fin, instead of through the channels 7, as shown in FIGS. 8 and 11.

As shown in FIG. 13, the mechanical bond between membranes 202 and fore strip 8, on one side, and the fin blade 2, on the other side, may be obtained by providing the edges of the concerned fin blade elements with a suitable number of slits 403', into which the material of the membranes 202 and of the strip 8 will flow during the molding operation.

Thanks to the above described embodiments of the invention, the fore edge of the fin blade will be provided with a border or strip 8 firmly secured to the fin blade and running smoothly and continuously from one side to the opposite one of the fin blade, without leaving discontinous zones, particularly at the membranes 202, thus avoiding the possibility that the said membranes may detach themselves from the remainder of the fin blade.

Of course, the present invention is not limited to the embodiments shown and described, and it comprises all those modifications falling within the scope of the following claims.

I claim:

1. A method of producing a swim fin having a shoe portion comprised of a first moldable material, a blade portion comprised of a second comparatively stiff material having a root portion disposed near said shoe portion and provided in a central region with a deformable self-shaping section, said shoe portion and said blade portion being connected together in a stable manner by molding in a mold said shoe portion on said blade portion proximate said root portion, said method comprising:

forming at least one longitudinal slit in the central region of said blade portion, wherein said slit extends from a free fore end of said blade portion to an area proximate said root portion of said blade portion;

forming at least one channel extending from said shoe portion to said slit; and allowing, concurrently with the molding operation of said shoe portion, the flow of said first moldable material into said slit to form said deformable self-shaping section.

2. The method according to claim 1, wherein said channel is formed in said blade portion.

3. The method according to claim 1, wherein said channel is formed in said mold.

4. The method according to claim 1, wherein said channel is formed in said blade portion and in said mold.

5. The method according to claim 1, further comprising the step of providing edges of said slit with a tenon-like ridge provided with through holes.

6. A method of producing a swim fin comprising a shoe portion comprised of a first moldable material, a blade portion comprised of a second comparatively stiff material having a root portion disposed near said shoe portion and provided with transversely bowed, longitudinally extending, membrane-like elements, said shoe portion and said blade portion being connected together in a stable manner by molding in a mold said shoe portion on said blade portion proximate said root portion, said method comprising:

forming two longitudinal slits in said blade portion, wherein said slit extends from a free fore end of said blade portion to an area proximate said root end of said blade portion;

forming at least one channel in said blade portion, said channel extending from said shoe portion to said slits;

allowing, concurrently with the molding operation of said shoe portion, the flow of said first moldable material into said slits to form said membrane-like elements.

7. The method according to claim 6, further comprising the step of providing the edges of said slits with tenon-like ridges provided with through holes.

8. A swim fin comprising:

a shoe member;

a blade member forming a forward extension of said shoe member, said blade member having a root portion disposed near said shoe member, and a fore edge spaced from said shoe member and said root portion, wherein said shoe member is molded to said blade member proximate said root portion of said blade to secure said blade to said shoe member;

two longitudinal stiffening ribs extending above said blade member and sidewise confining said blade member;

two spaced apart, narrow, longitudinal openings formed in said blade member wherein each opening is close to a different stiffening rib, and each opening extends from the fore edge of said blade member to an area proximate said root portion of said blade member;

a flexible, membrane-like element disposed in each of the longitudinal openings and secured to said blade member;

a continuous ribbon of material bonded to said root portion of said blade member and connecting each of said membrane-like elements to said shoe member;

wherein said shoe member, said membrane-like elements, and said ribbons are molded from the same mass to form a supple, pliable material, and said blade member consists essentially of a stiff material.

9. A swim fin as claimed in claim 8, wherein said stiffening ribs have inwardly facing flanks that form an angle of about 90° with said blade member.

10. A swim fin as claimed in claim 8, wherein said membrane-like elements are secured to said blade member by at least a mechanical bond.

11. A swim fin as claimed in claim 10, wherein said blade member is provided with recesses adjacent said openings, and said supple, pliable material fills said recesses to form mechanical bonding means integral with said membrane-like elements.

12. A swim fin as claimed in claim 11, wherein said recesses are in the form of a multiplicity of bores or slots, and said supple, pliable material fills said bores and slots.

13. A swim fin as claimed in claim 10, wherein said openings are defined by edges of said blade member, and said edges are provided with tenon-like ridges having recessed apertures, and said supple, pliable material fills said ridges and apertures to form mechanical bonding means integral with said membrane-like elements.

14. A swim fin as claimed in claim 13, wherein said apertures are in the form of a multiplicity of bores or slots, and said supple, pliable material fills said bores and slots.

15. A swim fin comprising:

a shoe member;

a blade member forming a forward extension of said shoe member, said blade member having a root portion disposed near said shoe member, and a fore edge spaced from said shoe member and said root portion, wherein said shoe member is molded to said blade member proximate said root portion of said blade to secure said blade to said shoe member;

two longitudinal stiffening ribs extending above said blade member and sidewise confining said blade member;

a continuous, smooth strip secured to the fore edge of said blade;

two spaced apart, narrow, longitudinal openings formed in said blade member wherein each opening is close to a different stiffening rib, and each opening extends from the fore edge of said blade member to an area proximate said root portion of said blade member;

a flexible, membrane-like element disposed in each of the longitudinal openings and secured to said blade member, wherein said membrane-like elements are integral with said smooth strip secured to the fore edge of said blade to thereby form a strong connection between said membrane-like elements and said blade member;

wherein said shoe member, said membrane-like elements, and said strip on said fore edge of said blade are molded from the same mass to form a supple, pliable material, and said blade member consists essentially of a stiff material.

16. A swim fin as claimed in claim 15, wherein said stiffening ribs have inwardly facing flanks that form an angle of about 90° with said blade member.

17. A swim fin as claimed in claim 15, wherein said membrane-like elements are secured to said blade member by at least a mechanical bond.

18. A swim fin as claimed in claim 17, wherein said blade member is provided with recesses adjacent said openings, and said supple, pliable material fills said recesses to form mechanical bonding means integral with said membrane-like elements.

19. A swim fin as claimed in claim 18, wherein said recesses are in the form of a multiplicity of bores or slots, and said supple, pliable material fills said bores and slots. strip.

20. A swim fin as claimed in claim 17, wherein said blade member is provided with recesses adjacent said openings and recesses adjacent said smooth strip, and said supple, pliable material fills said recesses to form mechanical bonding means integral with said membrane-like elements and said smooth strip.

21. A swim fin as claimed in claim 20, wherein said recesses are in the form of a multiplicity or bores or slots, and said supple, pliable material fills said bores and slots.

22. A swim fin as claimed in claim 17, wherein said openings are defined by edges of said blade member, and said edges are provided with tenon-like ridges having recessed apertures, and said supple, pliable material fills said ridges and apertures to form mechanical bonding means integral with said membrane-like elements.

23. A swim fin as claimed in claim 22, wherein said apertures are in the form of a multiplicity of bores or slots and said supple, pliable material fills said bores and slots.

24. A swin fin as claimed in claim 15, wherein said fore edge of said blade member is provided with recesses adjacent said smooth strip, and said supple, pliable material fills said recesses to form mechanical bonding means integral with said strip.

25. A swin fin as claimed in claim 24, wherein said recesses are in the form of a multiplicity of bores or slots and said supple, pliable material fills said bores or slots.

* * * * *